US006474999B1

(12) United States Patent
Givens et al.

(10) Patent No.: US 6,474,999 B1
(45) Date of Patent: Nov. 5, 2002

(54) ELECTRICAL CONNECTOR HAVING PRINTED CIRCUIT BOARD MOUNTED THEREIN

(75) Inventors: David F. Givens; Leonard K. Espenshade, both of Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/002,367

(22) Filed: Nov. 1, 2001

(51) Int. Cl.[7] ..... H01R 24/04

(52) U.S. Cl. ..... 439/76.1; 439/541.5; 439/676; 439/38

(58) Field of Search ..... 439/541.5, 607–610, 439/490, 488, 38, 76.1, 676, 620

(56) References Cited

U.S. PATENT DOCUMENTS 4,978,317 A * 12/1990 Pocrass ..... 439/490
5,797,770 A * 8/1998 Davis et al. ..... 430/607
5,876,240 A * 3/1999 Derstine et al. ..... 439/490
6,022,245 A * 2/2000 Minich ..... 439/620
6,120,321 A * 9/2000 Wu ..... 439/541.5
6,159,039 A * 12/2000 Wu ..... 439/541.5
6,162,089 A * 12/2000 Costello et al. ..... 439/541.5
6,183,292 B1 * 2/2001 Chen et al. ..... 439/541.5
6,227,911 B1 * 5/2001 Boutros et al. ..... 439/490
6,283,786 B1 * 9/2001 Margulis et al. ..... 439/490
6,319,051 B1 * 11/2001 Chang et al. ..... 439/490

* cited by examiner

*Primary Examiner*—Gary F. Paumen
(74) *Attorney, Agent, or Firm*—Wei Te Chung

(57) ABSTRACT

An electrical connector (1) includes an insulative housing (2) defining a receiving cavity (26), a contact insert (3), a conductive outer shield (4) enclosing the insulative housing, and a number of LED elements (5, 6) assembled to the insulative housing. The contact insert extends in the receiving cavity and divides the receiving cavity into a pair of plug-receiving cavities. The contact insert has a printed circuit board (36), a pair of contact modules (30) respectively mounted to a first and a second surfaces of the printed circuit board, a pair of magnetic modules (32) electrically mounted to the first surface of the printed circuit board and a pair of footers (34) mounted to the second surface of the printed circuit board. The contact modules respectively have electrical contacts (302) extending into the plug-receiving cavities and electrically connected with the footers through the printed circuit board.

1 Claim, 11 Drawing Sheets

ELECTRICAL CONNECTOR HAVING PRINTED CIRCUIT BOARD MOUNTED THEREIN

BACKGROUND OF THE INVENTION

1. Field of the Invention

The present invention relates to an electrical connector, and particularly to an electrical connector having a printed circuit board mounted therein.

2. Description of the Related Art

Electrical connectors, for example modular jack connectors, may be formed in stacked type to save the space occupied thereby on a printed circuit board to which the electrical connector are mounted. A printed circuit board with magnetic modules thereon is also, as disclosed in U.S. Pat. No. 6,022,245, sometimes mounted in a stacked electrical connector to filter unwanted noise and to reduce the cross-talk when the stacked electrical connector works on a high speed signal transmission condition.

Upper and lower receiving cavities defined in an insulative housing of the stacked electrical connector of U.S. Pat. No. 6,022,245 for receiving complementary and plug connectors are separated from each other by an intermediate wall of the insulative housing and the printed circuit board vertically stands at a rear portion of the insulative housing of the stacked electrical connector. The printed circuit board is further connected to electrical contacts of an edge connector at a rear and lower portion of the insulative housing to connect electrical contacts, which mate with the plug or complementary connector and connect with the printed circuit board, with a printed circuit board to which the modular connector is mounted.

The structure of the electrical connector of U.S. Pat. No. 6,022,245 is obviously complicated and the cost of the electrical connector is thus relatively high.

Therefore, an improved electrical connector is desired to overcome the disadvantages mentioned above.

SUMMARY OF THE INVENTION

A major object of the present invention is to provide a structurally simplified and cost-effective electrical connector.

An electrical connector in accordance with the present invention comprises an insulative housing defining a receiving cavity, a contact insert, a conductive outer shield enclosing the insulative housing and a plurality of LED elements assembled to the insulative housing. The contact insert extends into the receiving cavity of the insulative housing to define a pair of plug-receiving cavities. The contact insert comprises a printed circuit board, a pair of contact modules, a pair of footers and a pair of magnetic modules electrically connected to the printed circuit board.

The contact modules comprise electrical contacts electrically connected to the footers through the printed circuit board and extending into the plug-receiving cavities, respectively, and insulative portions mechanically mounting the contact modules to the printed circuit board. The contact insert is secured in the insulative housing by the printed circuit board and the insulative portions.

Other objects, advantages and novel features of the invention will become more apparent from the following detailed description of the present embodiment when taken in conjunction with the accompanying drawings.

DETAILED DESCRIPTION OF THE INVENTION

Figure 1:
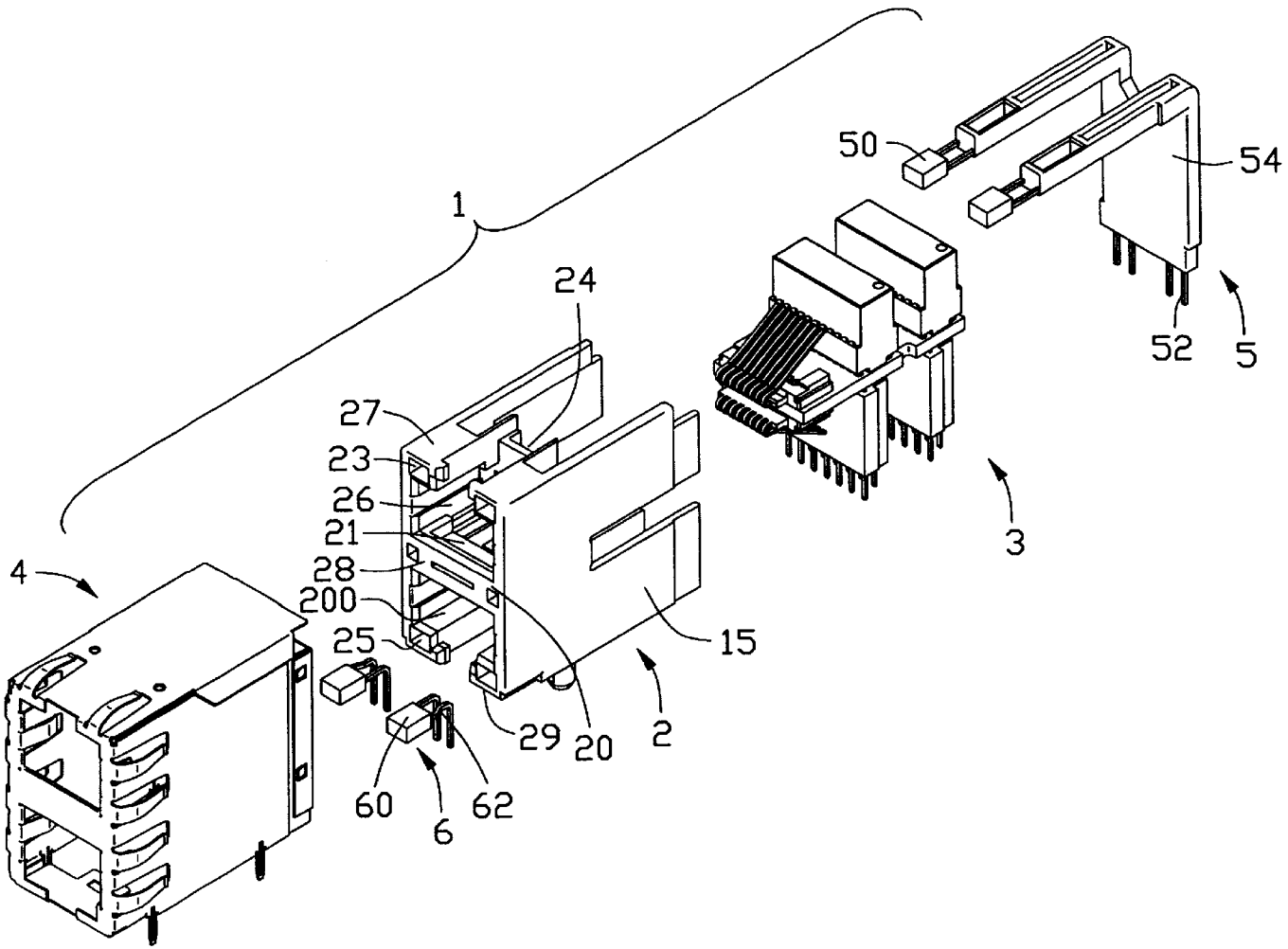
FIG. 1 is an exploded view of an electrical connector in accordance present invention.

Referring to FIG. 1, an electrical connector 1 in accordance with the present invention comprises an insulative housing 2, a contact insert 3, a conductive outer shield 4, an upper Light Emitting Diode (LED) element 5 and a pair of lower LED elements 6.

Figure 8:
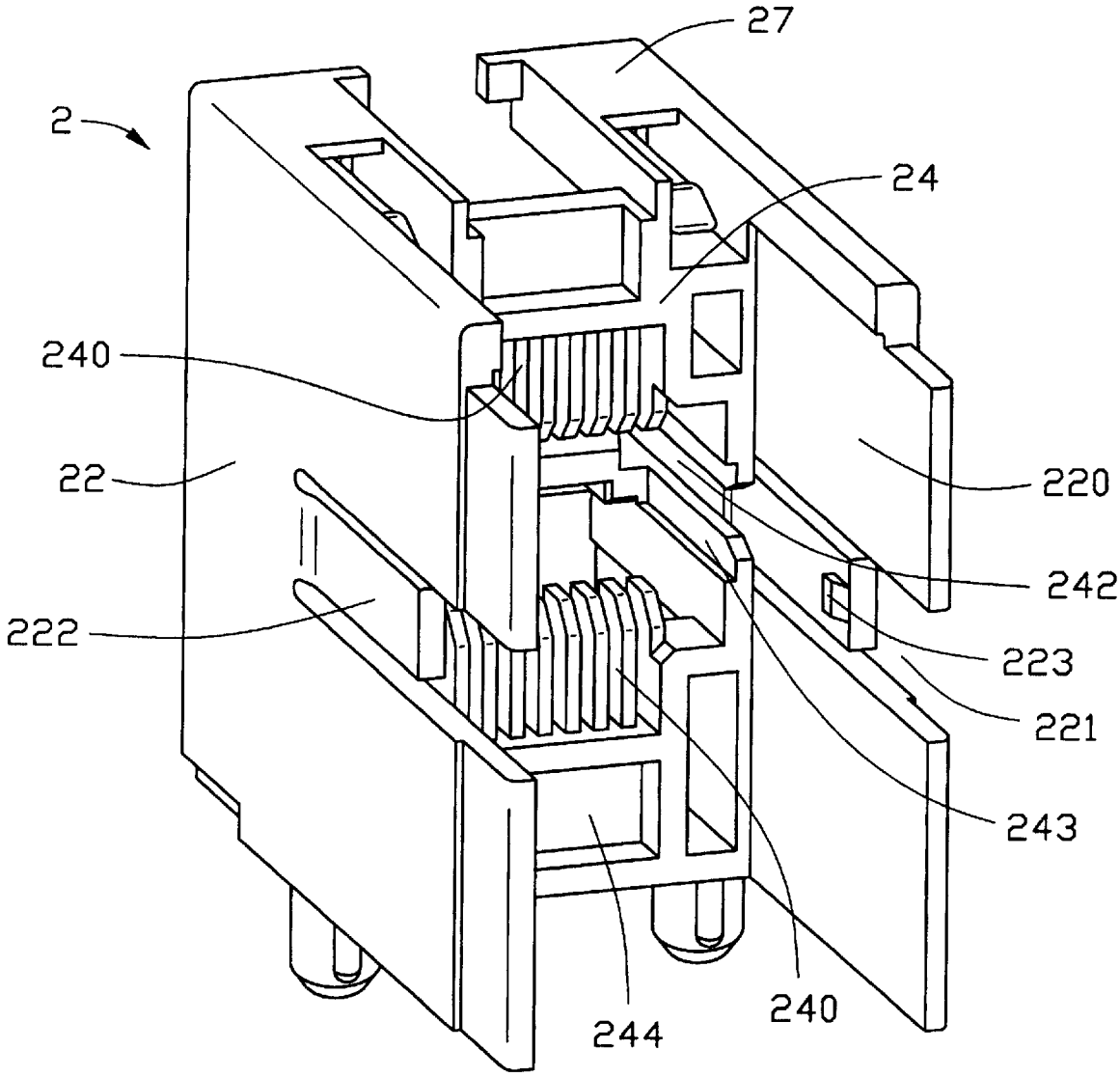
FIG. 8 is a perspective view of an insulative housing of the electrical connector of FIG. 1.

Referring also to FIG. 8, the insulative housing 2 comprises a front wall 20, a pair of side walls 22, a rear wall 24 opposite to the front wall 20, a top wall 27 and a bottom wall 29 opposite to the top wall 27. The insulative housing 2 defines a receiving cavity 26 confined by the front, side, rear, top and bottom walls 20, 22, 24, 27, 29. A beam 28 extends rearwardly from midway of the front wall 20 into the receiving cavity 26 and connects front portions of the opposite side walls 22. The front wall 20 defines an upper and a lower openings 200 separated by the beam 28. A pair of opposite cutouts 21 (only one shown) are formed on a rear portion of the beam 28 and communicate with the receiving cavity 26. A pair of upper cavities 23 are defined in the top wall 27 and extend from the front wall 20 to the rear wall 24. A pair of lower cavities 25 are defined in the bottom wall 29 and open to the front wall 20. A channel 250 recesses from a bottom face of the bottom wall 29 and communicates with each lower cavity 25. A pair of slits 252 communicating with both the channel 250 and the lower cavity 25 extend in a direction parallel to a direction in which the lower cavity 25 extends.

The side walls 22 each comprise a pair of wings 220 extending rearwardly beyond the rear wall 24 and spaced from each other by a channel 221 open to a rear end thereof. The rear wall 24 and the wings 220 of the side walls 22 define a space 244 therebetween. A tongue 222 extends rearwardly in the channel 221 and is parallel to the wings 220. Rear ends of the tongues 222 are forwardly of rear ends of the wings 220. A barb 223 protrudes inwardly from an inner face of the rear end of each tongue 222 into the space 244. The rear wall 24 defines spaced upper and lower rows of passages 240 therein. The upper row of passages 240 is opposite to the lower row of passages 240. Each side wall 22 defines a groove 242 extending forwardly from adjacent to the rear wall 24 and open inwardly and rearwardly with rear ends thereof enlarged. A pair of recesses 243 are defined adjacent to upper and lower portions of each groove 242 to be in communication with the groove 242.

Figure 9:
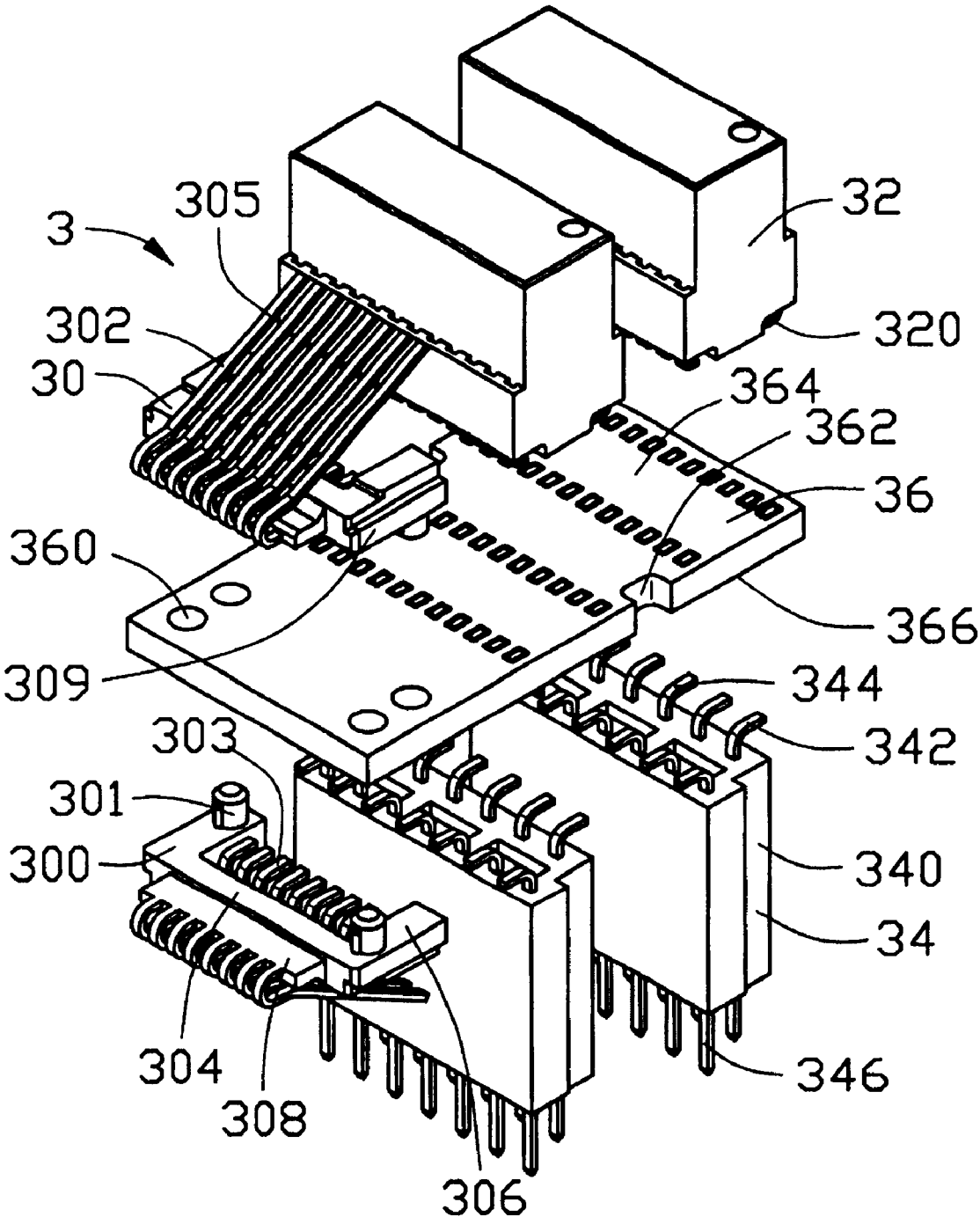
FIG. 9 is an exploded view of a contact insert of the electrical connector of FIG. 1.
Figure 10:
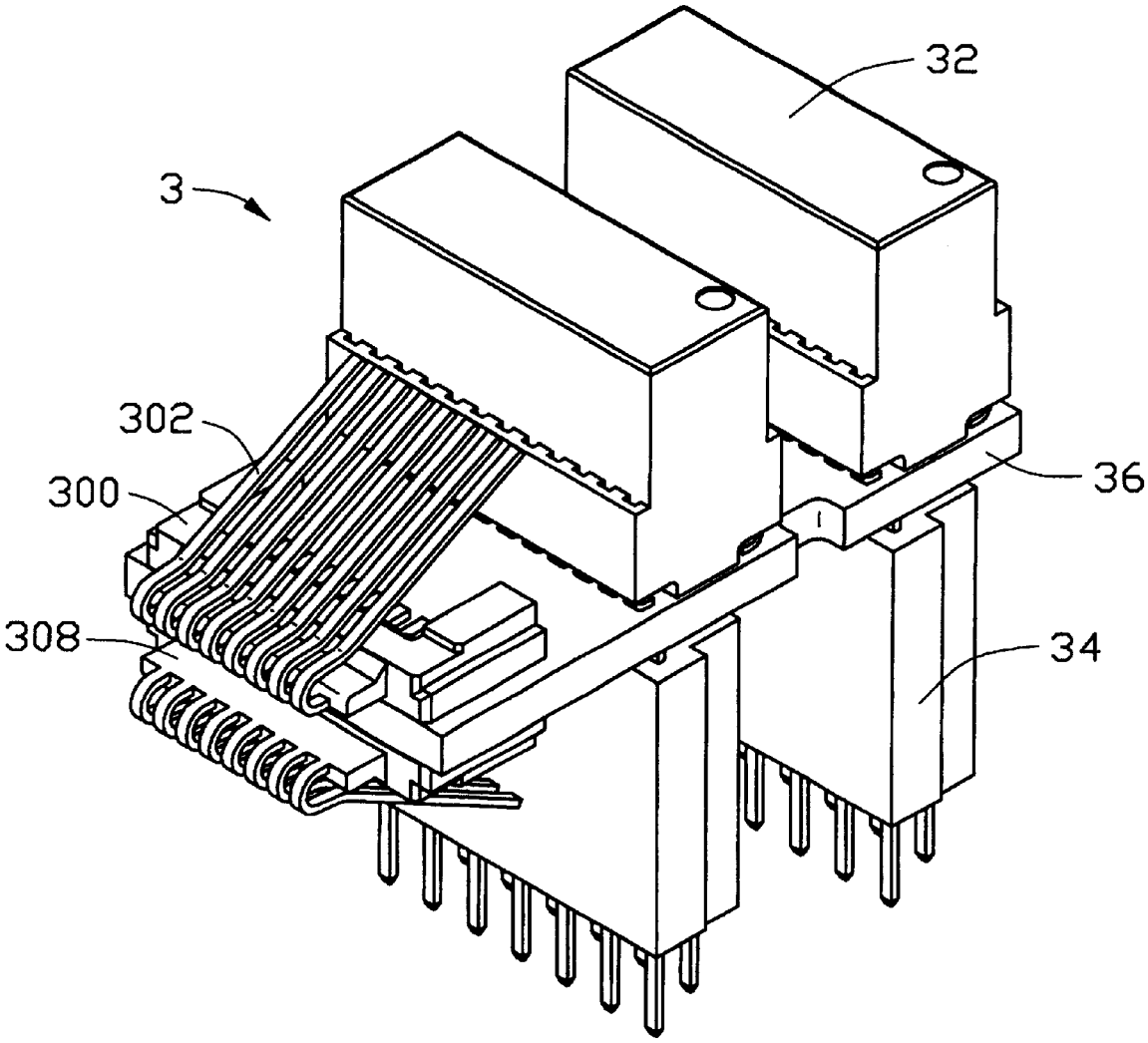
FIG. 10 is an assembled perspective view of the contact insert of FIG. 9.
Figure 11:
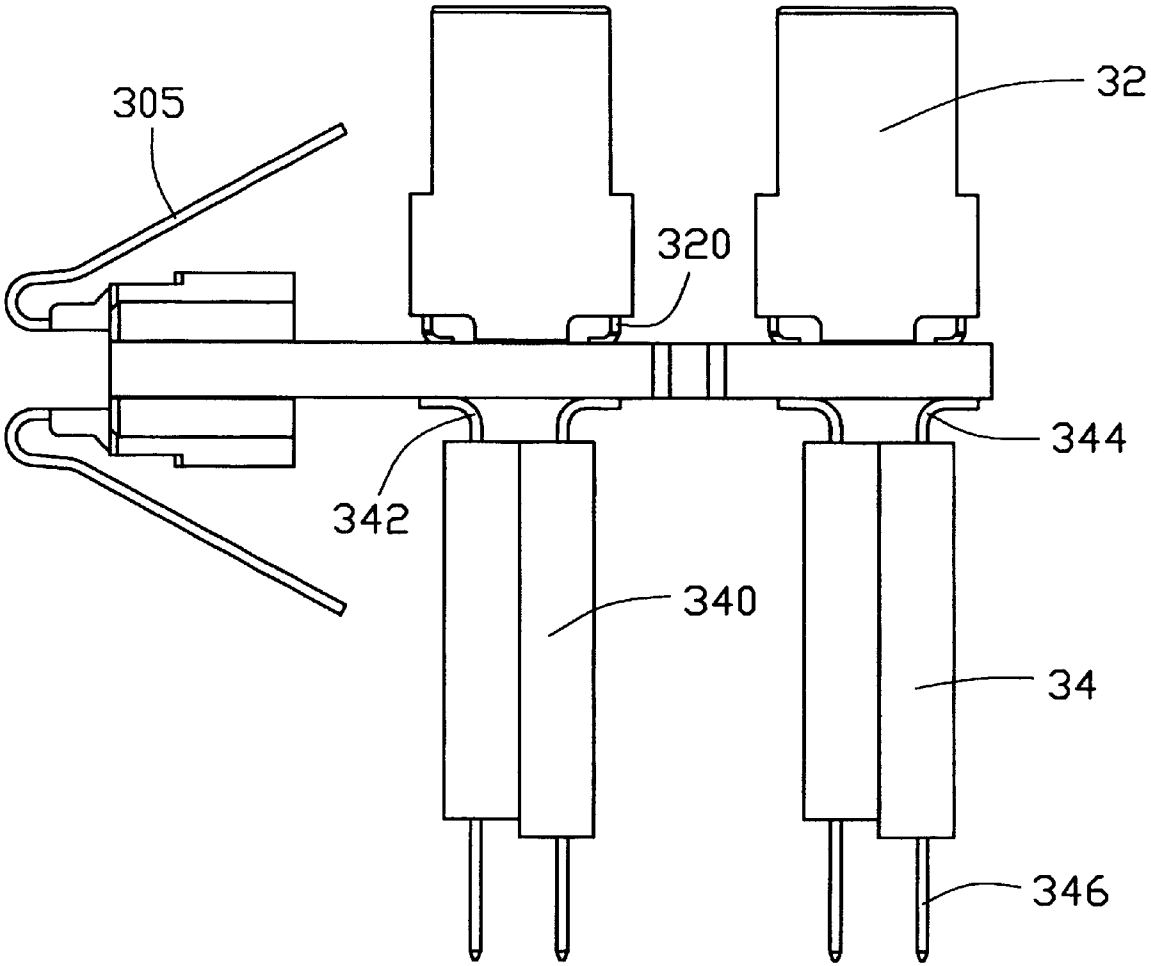
FIG. 11 is a side-elevational view of the contact insert of FIG. 9.

Referring also to FIGS. 9—11, the contact insert 3 comprises a pair of contact modules 30, a pair of magnetic modules 32, a pair of footers 34 and a printed circuit board 36. Each contact module 30 comprises an insulative portion 300 and a plurality of electrical contacts 302. Each insulative portion 300 comprises a body section 304, a pair of arm sections 306 extending rearwardly from opposite sides of the body section 304 and a forward section 308 extending forwardly from the body section 304. Each arm section 306 comprises a shoulder 309 at an outward edge thereof and a post 301 protruding outwardly from one surface thereof. The post 301 of one arm section 306 is offset from the post 301 of the other arm section 306 of the insulative portion 300. That is, the post 301 of one arm section 306 is formed at a proximate portion of the arm section 306 adjacent to the body section 304 while the post 301 of the other arm section 306 is formed at a distal portion of the arm section 306 distant from the body section 304.

Each electrical contact 302 comprises a mounting portion 303 extending rearwardly beyond the body section 304 and parallel to the arm sections 306 and a contacting portion 305 extending upwardly and rearwardly from the forward section 308.

Each magnetic module 32 comprises a plurality of terminals 320 extending downwardly from two opposite sides thereof. Since the magnetic modules 32 are well known to persons skilled in the pertinent art, a detailed description therefor is omitted herefrom.

Figure 4:
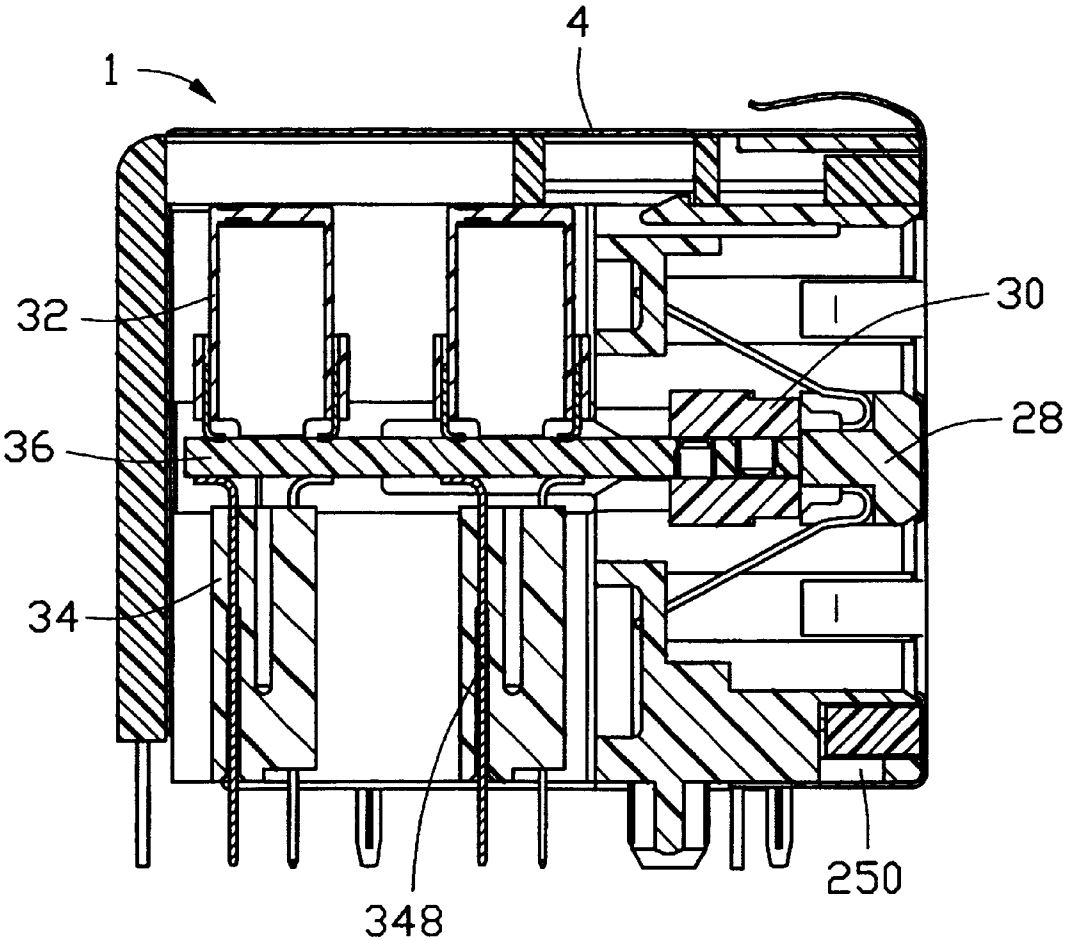
FIG. 4 is a cross-sectional view taken along line 4—4 of FIG. 3.
Figure 5:
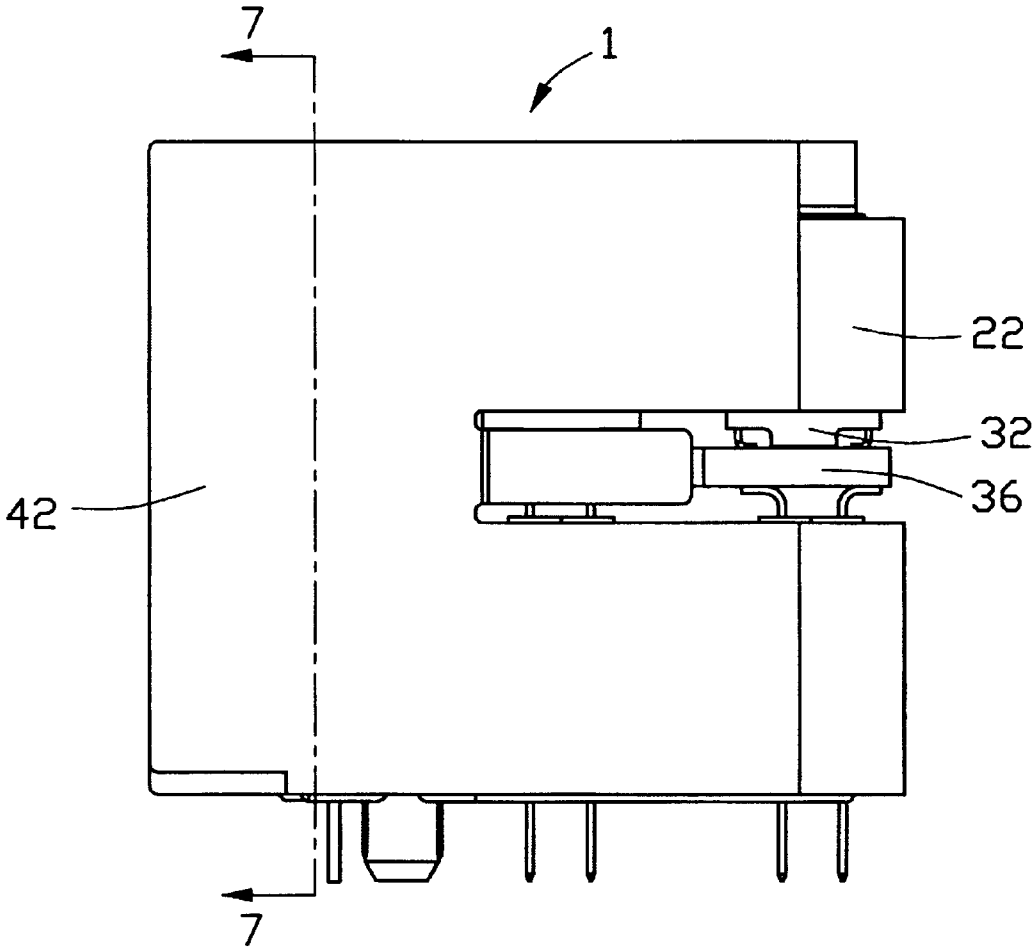
FIG. 5 is a side-elevational view of the electrical connector of FIG. 1 with an outer shield being removed therefrom.
Figure 6:
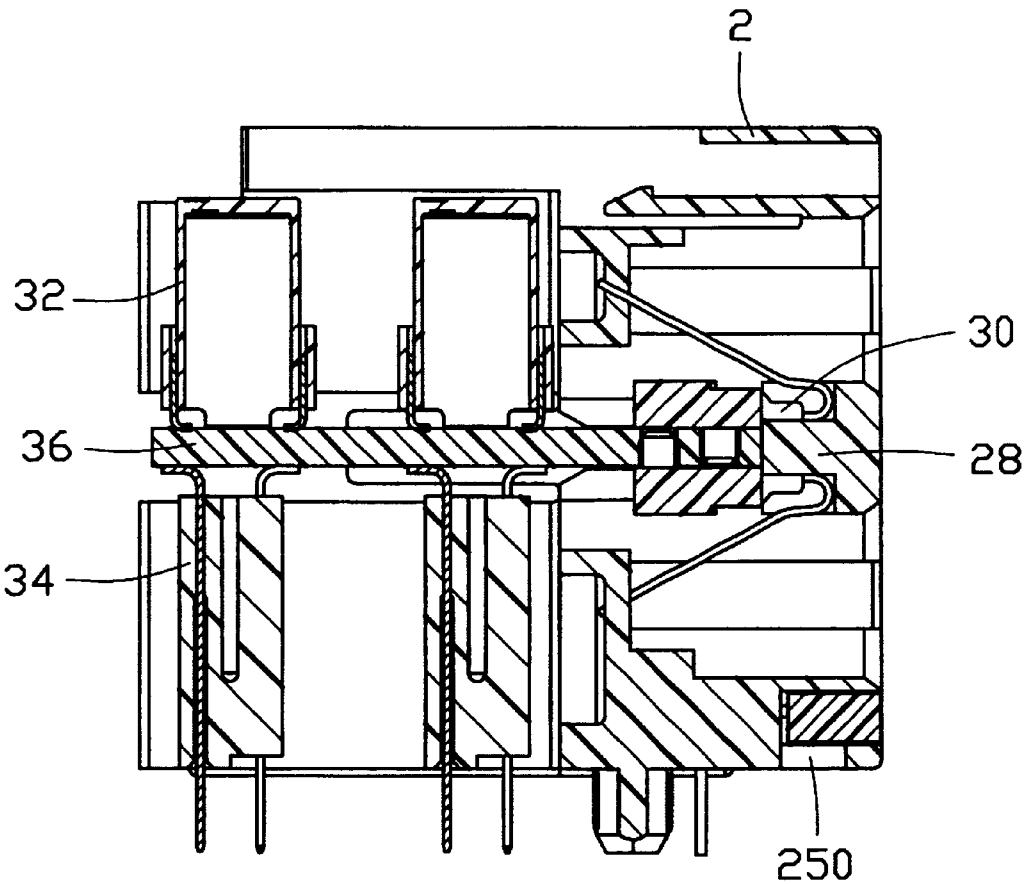
FIG. 6 is a view similar to FIG. 4, but the outer shield is removed therefrom.
Figure 7:
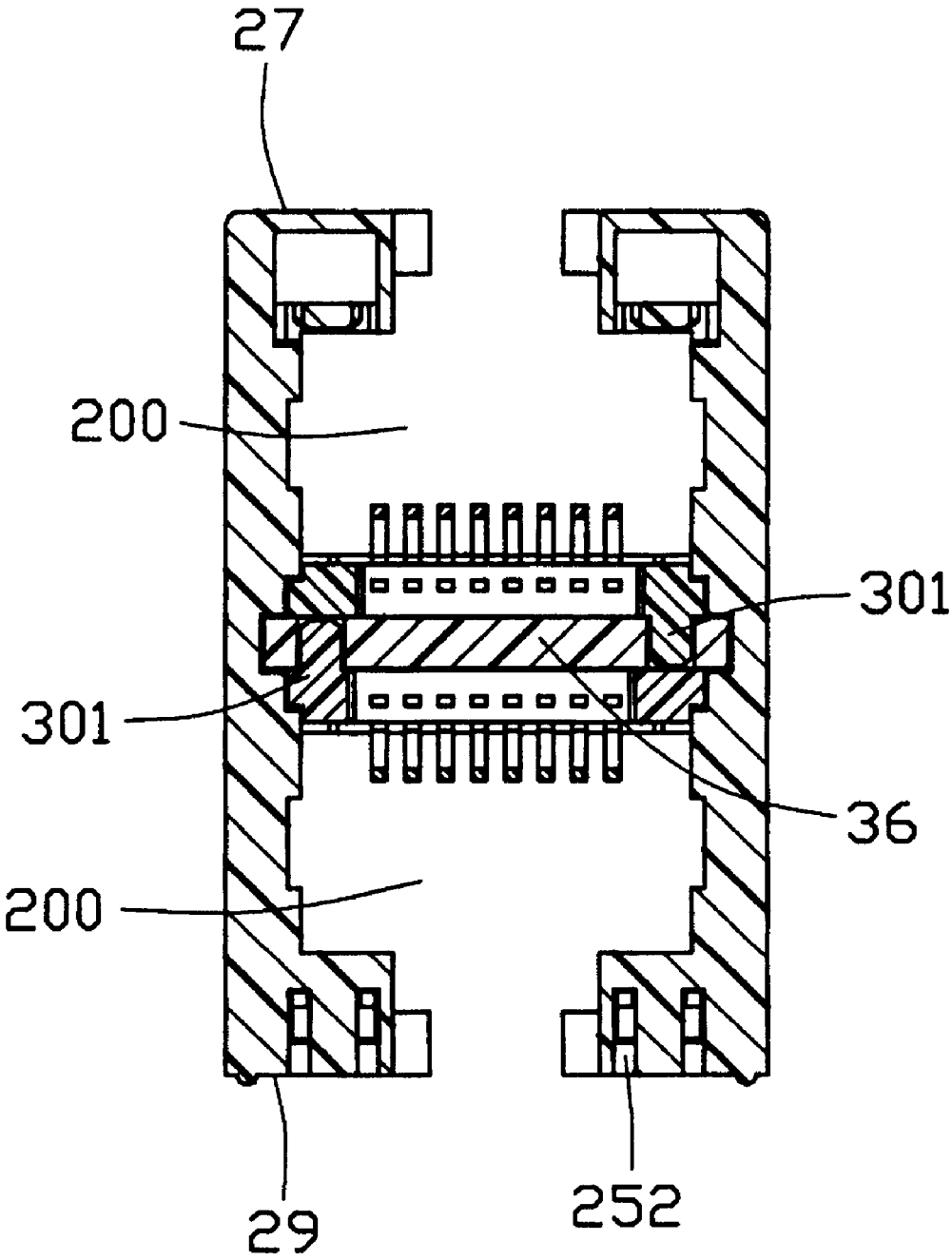
FIG. 7 is a cross-sectional view taken along line 7—7 of FIG. 5.

Each footer 34 comprises a retention portion 340 and a plurality of electrical terminals 342 retained to the retention portion 340. Each electrical terminal 342 comprises a printed circuit contacting portion 344 extending outwardly from an end of the retention portion 340, a printed circuit mounting portion 346 extending outwardly from an opposite end of the retention portion 340 to be mounted to a printed circuit board (not shown) onto which the electrical connector 1 is mounted and a fixing portion 348 (shown in FIG. 4) fixed in the retention portion 340. The electrical terminals 342 of each footer 34 are arranged into two parallel rows.

The printed circuit board 36 is formed with two pairs of through holes 360 at two opposite sides of a front portion thereof and a pair of retaining cutouts 362 at two opposite edges of a rear portion thereof. The printed circuit board 36 defines an upper surface 364 and a lower surface 366 opposite to the upper surface 364. The printed circuit board 36, as known to one of ordinary skill in the pertinent art, comprises a grounding plane (not shown) therein, if desired.

Figure 2:
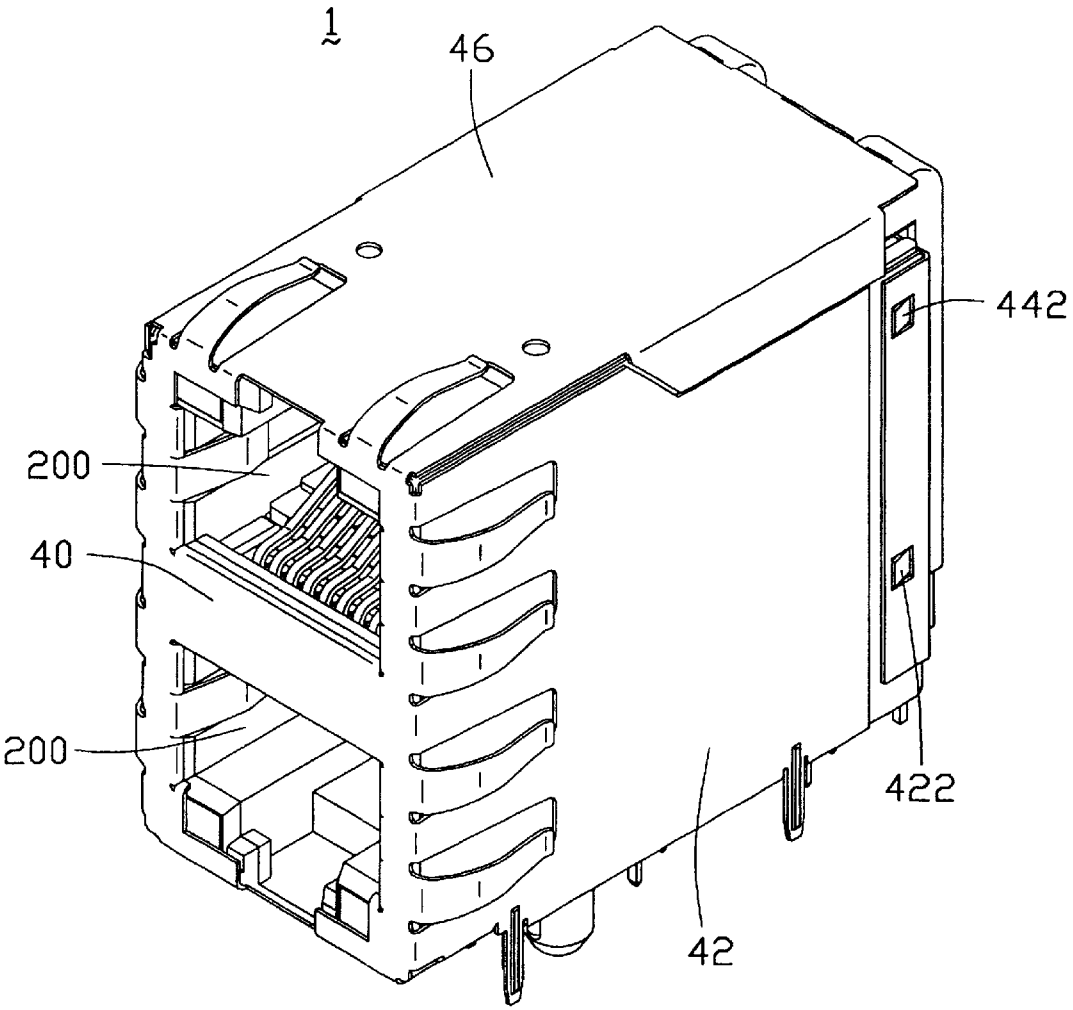
FIG. 2 is an assembled perspective view of the electrical connector of FIG . 1.
Figure 3:
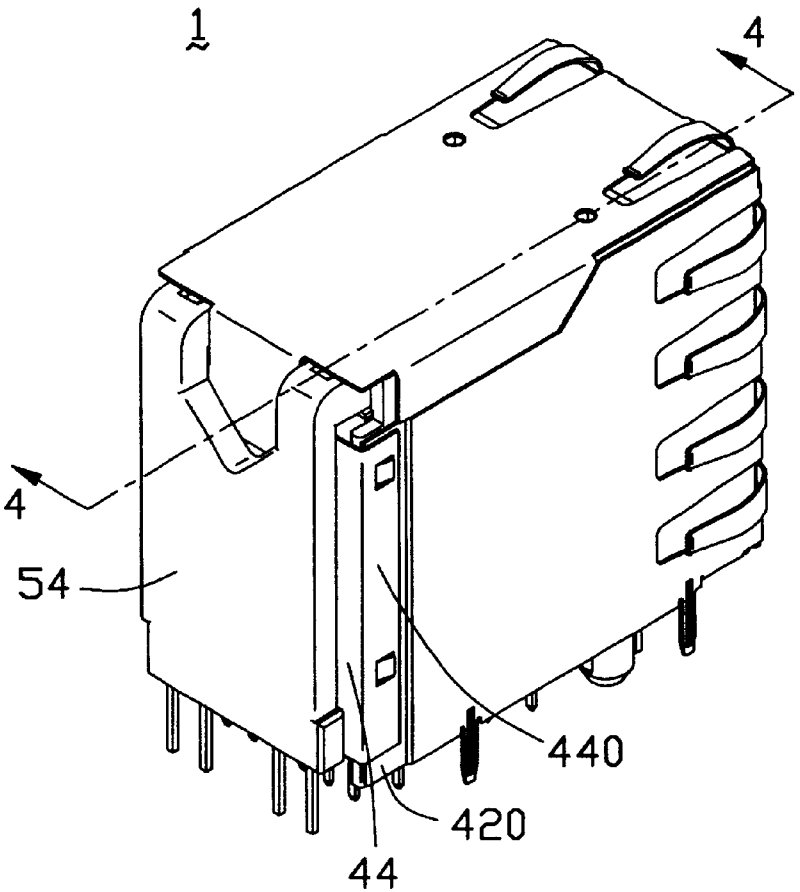
FIG. 3 is a view similar to FIG. 2, but taken from a different perspective.

Referring also to FIGS. 2 and 3, the conductive outer shield 4 includes a front wall 40, a pair of side walls 42, a rear wall 44 and a top wall 46. The front wall 40 has a pair of shield openings corresponding to the upper and lower openings 200 of the front wall 20 of the insulative housing 2, respectively. Each side wall 42 comprises a flange 420 at a rear edge thereof and each flange 420 is formed with a pair of tabs 422. The rear wall 44 comprises a pair of flanges 440 and each flange 440 defines a pair of windows 442 corresponding to the tabs 422 of the side walls 42.

The upper LED element 5 comprises a pair of heads 50, and two pairs of leads 52 corresponding to the heads 50, respectively, and the upper LED element 5 is arranged in such a way that the heads 50 are spaced from each other while the leads 52 extend downwardly from a common body 54.

Each lower LED element 6 comprises a head 60 and a pair of leads 62 extending from the head 60.

In assembly, the posts 301 of the contact modules 30 are inserted into the through holes 360 of the printed circuit board 36, respectively, to position the contact modules 30 to the upper and the lower surfaces 364, 366 of the printed circuit board 36, respectively. The mounting portions 303 of the electrical contacts 302 are soldered to the printed circuit board 36. The contacting portions 305 of the electrical contacts 302 of one contact module 30 extend beside the upper surface 364 of the printed circuit board 36 and the contacting portions 305 of the electrical contacts 302 of another contact module 30 extend beside the lower surface 366 of the printed circuit board 36.

The terminals 320 of the magnetic modules 32 are soldered to the printed circuit board 36 to be electrically connected with electrical circuits (not shown) of the printed circuit board 36 and the magnetic modules 32 are thus mounted on the upper surface 364 of the printed circuit board 36.

The printed circuit board contacting portions 344 of the electrical terminals 342 of the footers 34 are mechanically retained to the printed circuit board 36 to mount the footers 34 to the lower surface 366 of the printed circuit board 36 and electrically connected with the electrical contacts 302 through the printed circuit board 36. In this way, the contact insert 3 is assembled.

Two opposite sides of the printed circuit board 36 and the shoulders 309 of the insulative portions 300 of the contact modules 30 are inserted in a back-to-front direction along the grooves 242 and the recesses 243, respectively, until the forward sections 308 of the contact modules 30 are accommodated in the cutouts 21 of the beam 28 and the insulative portions 300 are then stopped by the beam 28 of the insulative housing 2. The barbs 223 of the tongues 223 of the insulative housing 2 engage with the retaining cutouts 362 of the printed circuit board 36. The assembled contact insert 3 is thus reliably accommodated in the insulative housing 2. The magnetic modules 32 and the footers 34 are accommodated in the space 244.

The receiving cavity 26 of the insulative housing 2 is divided by the printed circuit board 36 into an upper portion and a lower portion corresponding to the upper and lower openings 200 of the front wall 20 of the insulative housing, respectively. The contacting portions 305 of the electrical contacts 302 of the contact modules 30 extend in the upper and the lower portions of the receiving cavity 26, respectively, thereby defining an upper and a lower plug-receiving cavities to receive a pair of plug or complementary electrical connector (not shown) thereinto. Free ends of the contacting portions 305, as known to one of ordinary skill in the pertinent art, deflectably extend in the upper and lower passages 240 to make the contacting portions 305 be deflectable by inserted plug or complementary electrical connector.

The lower LED elements 6 are inserted upwardly through the channels 250 to position the heads 60 in the lower cavities 25. The leads 62 extend via the passages 252 beyond the insulative housing 2 to be mountable to the printed circuit board onto which the electrical connector 1 is mounted.

The front, side and top walls 40, 42, 46 of the outer shield 4 enclose the top, side and top walls 20, 22, 27 of the insulative housing 2, respectively. The shield openings of the front wall 40 of the outer shield 4 align with the upper and the lower receiving plug-receiving cavities, respectively. The rear wall 44 of the outer shield 4 extends parallel to the rear wall 24 of the insulative housing 2. The flanges 440 of the rear wall 34 overlap the flanges 420 of the side walls 42 and the tabs 422 extend into the windows 442 to provide a retention between the rear wall 44 and the side walls 42, thereby the outer shield 4 being reliably secured around the insulative housing 2.

The upper LED elements 5 is inserted in the back-to-front direction from a space (not labeled) between the top wall 46 and the rear wall 44 of the outer shield 4 into the upper cavities 23 of the insulative housing 2 and the common body 54 extends rearwardly of and abuts against the rear wall 44 of the outer shield 4.

The printed circuit board 36 not only structurally separates and supports the insulative housing 2, but also has magnetic modules 32 thereon to filter unwanted noises and reduce the cross-talk between the contact modules 30. Thus, the insulative housing 2 need not form an intermediate wall therein to separate plug-receiving cavities. The structure of the insulative housing 2 and the assembling procedure of the electrical connector 1 are simplified. Therefore, the electrical connector 1 is compact and cost-effective.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a front wall defining a first and a second opening and defining a receiving cavity in communication with the first and the second openings; and a contact insert extending into the receiving cavity to define a first and a second plug-receiving cavity corresponding to the first and the second openings, respectively, the contact insert comprising a printed circuit board, and a first and a second contact module each having electrical contacts electrically soldered on the printed circuit board and extending into the first and the second plug-receiving cavities, the contact insert further comprising a first and a second footer mounted on the printed circuit board and electrically connected to the electrical contacts of the first and the second contact modules through the printed circuit board;

wherein each of the first and the second contact modules comprises an insulative portion and the electrical contacts are retained thereto, each electrical contact comprising a contacting portion extending into one of the first and the second plug-receiving cavities and a mounting portion electrically soldered to the printed circuit board;

wherein each of the first and the second contact modules comprises an insulative portion, the insulative portion comprising a body section retaining the electrical contacts, a pair of arm sections extending from the body section and a forward section extending forwardly from the body section, and the front wall of the insulative housing comprising a beam separating the first and the second openings and defining a pair of opposite cutouts to receive the forward sections of the insulative sections;

wherein each electrical contact comprises a contacting portion extending upwardly and rearwardly from the forward section of the insulative portion into one of the first and the second plug-receiving cavities and a mounting portion extending from the body section between the arm sections of the insulative portion to be electrically soldered to the printed circuit board;

wherein the printed circuit board defines a first surface and a second surface opposite to the first surface and the mounting portions of the electrical contacts of the first and the second contact modules are soldered to the first and the second surfaces, respectively, while the contacting portions of the electrical contacts of the first and the second contact modules extend beside the first and the second surfaces of the printed circuit board, respectively;

wherein the contact insert comprises a pair of magnetic modules attached to the first surface of the printed circuit board and the footers are attached to the second surface of the printed circuit board;

wherein the insulative housing defines two pairs of recesses and the arm sections of the insulative portions of the first and the second contact modules comprises shoulders received in the recesses;

wherein the insulative housing defines a groove between each pair of adjacent recesses and two opposite sides of the printed circuit board extend into the grooves;

wherein each arm section of the insulative portions of the first and the second contact modules comprises a post and the printed circuit board defines a plurality of through holes for receiving the posts;

wherein the posts of the arm sections of the insulative portion of one of the first and second contact modules are offset from each other;

further comprising a conductive outer shield enclosing the insulative housing;

further comprising an upper LED element and a pair of lower LED elements received in the insulative housing;

wherein the upper LED element comprises a pair of heads and a pair of leads extending from each head and retained by a common body;

wherein each footer comprises a plurality of electrical terminals and each electrical terminal comprises a printed circuit board contacting portion electrically connected with the electrical contacts through the printed circuit board and a printed circuit board mounting portion connected to the printed circuit board contacting portion;

wherein the insulative housing comprises a pair of side walls connected with the front wall and each side wall comprises a barb, the printed circuit board defines a pair of retaining cutouts engaging with the barbs of the side walls of the insulative housing.

* * * * *